US009243837B2

(12) United States Patent
Buchstab et al.

(10) Patent No.: US 9,243,837 B2
(45) Date of Patent: Jan. 26, 2016

(54) DISPENSING DEVICE FOR FREE-FLOWING OR POURABLE PRODUCTS

(75) Inventors: Martin Buchstab, Bopfingen (DE); Irene Dumkow, Sontheim (DE); Adolf Feinauer, Giengen (DE); Klaus Flinner, Zöschingen (DE); Bernd Heger, Haunsheim (DE); Marek Myszko, Cambridge (GB); Peter Nalbach, Kirchheim/Nabern (DE); Nathan Wrench, Cambridge (GB); Kasim Yazan, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 2301 days.

(21) Appl. No.: 12/085,808

(22) PCT Filed: Oct. 31, 2006

(86) PCT No.: PCT/EP2006/067956

§ 371 (c)(1),
(2), (4) Date: Sep. 8, 2009

(87) PCT Pub. No.: WO2007/062950

PCT Pub. Date: Jun. 7, 2007

(65) Prior Publication Data

US 2010/0031691 A1 Feb. 11, 2010

(30) Foreign Application Priority Data

Nov. 30, 2005 (DE) ..... 10 2005 057 164

(51) Int. Cl.

| | |
|---|---|
| ***B67D 7/80*** | (2010.01) |
| ***F25D 23/12*** | (2006.01) |
| ***F25C 5/00*** | (2006.01) |

(52) U.S. Cl.

CPC ..... *F25D 23/126* (2013.01); *F25C 5/005* (2013.01); *F25C 2400/10* (2013.01); *F25C 2500/06* (2013.01)

(58) Field of Classification Search

CPC ..... B67D 3/00; B67D 7/80; A23G 9/26
USPC ..... 141/351, 360; 62/340, 389–400; 222/129.1, 146.1, 146.6, 533–536, 488
See application file for complete search history.

(56) References Cited

U.S. PATENT DOCUMENTS

| | | | | |
|---|---|---|---|---|
| 3,476,295 | A * | 11/1969 | Telfer | 222/183 |
| 6,135,173 | A * | 10/2000 | Lee et al. | 141/361 |
| 7,007,500 | B2 * | 3/2006 | Lee | 62/389 |
| 2004/0187516 | A1 * | 9/2004 | Lee | 62/389 |
| 2005/0056043 | A1 * | 3/2005 | Lee et al. | 62/344 |

FOREIGN PATENT DOCUMENTS

EP 1 519 131 3/2005

OTHER PUBLICATIONS

International Search Report PCT/EP2006/067956.

* cited by examiner

*Primary Examiner* — Paul R Durand
*Assistant Examiner* — Andrew P Bainbridge
(74) *Attorney, Agent, or Firm* — James E. Howard; Andre Pallapies

(57) ABSTRACT

A dispensing device for free-flowing or pourable products, in particular in a refrigeration device. Said dispensing device has a feed pipe for a pourable product, comprising an exit opening and a shut-off flap that is situated at the exit opening, and an outlet for the free-flowing product, said outlet being attached to the flap and displaceable with the latter.

8 Claims, 3 Drawing Sheets

DISPENSING DEVICE FOR FREE-FLOWING OR POURABLE PRODUCTS

BACKGROUND OF THE INVENTION

The present invention relates to a dispensing device for free-flowing or pourable products, especially a dispensing device for cooled water and ice in a refrigeration device.

Refrigeration devices with built-in ice makers and a dispensing device for ice or cooled water are enjoying increasing popularity. In general these dispensing devices have an exit opening for ice and a water outlet which are accommodated on the outside of the refrigeration device so that a user can obtain water and ice without having to open a door.

There are different designs of dispensing device known for refrigeration devices which allow a container at one and the same location to be filled both with water and also with ice. In a first known design a vertical feed channel for ice has an exit opening, below which a container to be filled is placed, and is filled with ice from a sideways direction. This falls freely in the feed channel into the container. In an upper area of the feed channel, away from the path of the ice, is located an outlet for water. The water likewise falls vertically through the feed channel into the container. Since the outlet may not block the path of the ice, it must be arranged high above the container, which means that water falls from a great height and there is the danger of splashing. The feed channel also forms a heat leak via which heat can get into the interior of the refrigeration device, which increases its energy consumption.

Another solution is to arrange the outlet for water offset to the side of an exit opening for the ice and to align it so that an angled stream of water is produced that hits the opening of a container to be filled just like the ice. This however regularly leads to the last drops of the filling process no longer hitting the container but falling down to the side of the latter.

BRIEF SUMMARY OF THE INVENTION

The object of the present invention is to create a dispensing device of the type specified at the start which allows a container at the same position to be filled with water and also with ice, which minimizes the danger of water splashing and which can be built into an insulating wall, without creating a strong heat bridge.

The object is achieved by a dispensing device with a feed tube for pourable products, comprising an exit opening and a shut-off flap that is situated at the exit opening, and an outlet for free-flowing products which is attached to the flap and is displaceable with the latter. The fact that the flap in its closed position closes off the feed tube means that it prevents warm air flowing through from one side on the wall into which the dispensing device is built to the other through the feed tube. If a container is placed under the flap so that, when the flap is open, ice can fall through the flap into the container, then in general a stream of liquid which leaves the outlet with a smaller horizontal speed component, also hits the container. Even drops that fall down from the exit opening at the end of the filling process arrive safely in the container.

To hit the container precisely, the outlet is preferably formed and/or aligned to generate a stream of liquid directed vertically downwards.

If the direction in which the ice falls deviates slightly from the vertical, the outlet can also be formed and/or aligned in order to generate a stream of liquid falling within a path which the ice follows.

An exit opening of the outlet for the water preferably lies within an imagined smallest vertical cylinder which encompasses the exit opening for the ice and the shut-off flap in its open position. A container of which the upper opening runs around the cylinder will thus definitely be hit by the ice and by the water.

To enable the movement of the flap to be followed the outlet is preferably connected to a tank via a flexible tube.

A shut-off valve is preferably arranged upstream from the tube to prevent this being subjected to a stationary high water pressure.

To largely prevent subsequent dripping after a filling process has ended, the outlet is preferably provided with a lip valve.

BRIEF DESCRIPTION OF THE DRAWINGS

Further features and advantages of the invention emerge from the description of an exemplary embodiment given below with reference to the enclosed figures. The figures show.

DETAILED DESCRIPTION OF THE PRESENT INVENTION

Figure 1:
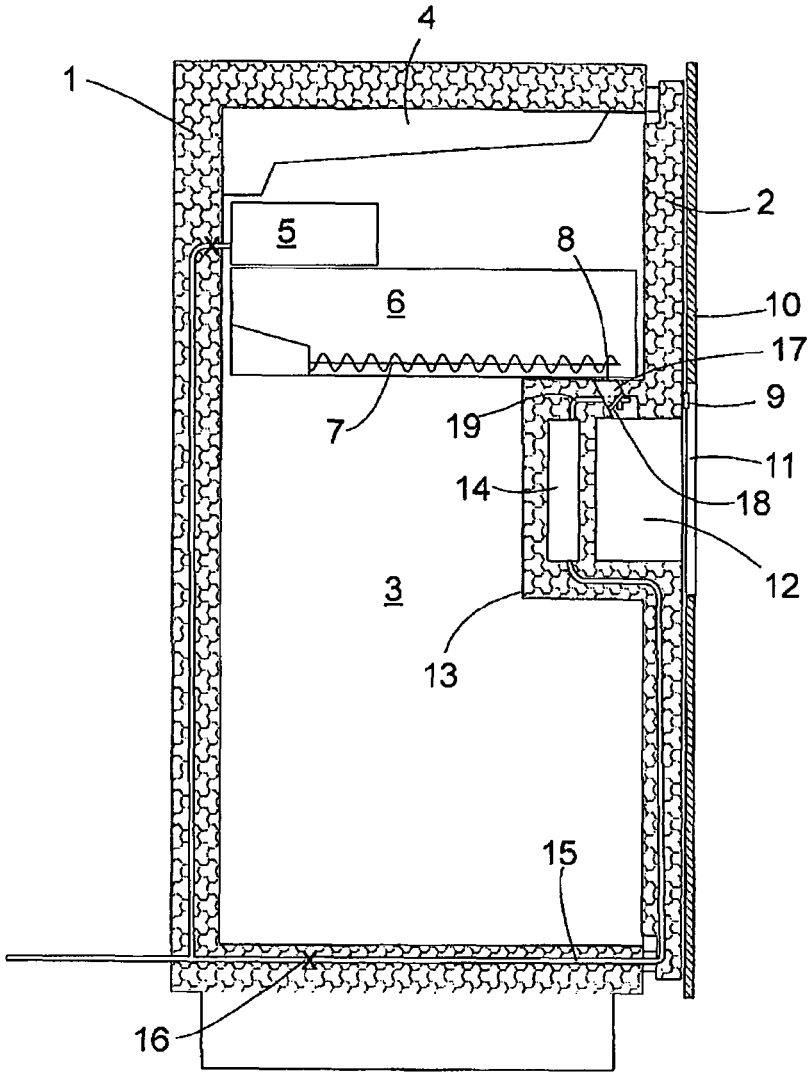
FIG. 1 a schematic section through a refrigerator that is equipped with a dispensing device as claimed in the present invention.

The refrigeration device shown in a schematic section in FIG. 1 has a thermally-insulated carcass 1 and a door 2, which delimit an interior 3. The door 2 here is shown clad with a trim panel 10. Cut into central area of the trim panel 10 is a window 11 which leaves free a recess 12 in the door and above the recess 12 a control panel with a number of buttons 9.

The interior 3 is cooled by an evaporator which is accommodated in an evaporator chamber 4 divided off in the upper area of the carcass.

An automatic ice maker 5 is arranged in the immediate vicinity of the evaporator chamber 4 in the interior 3, so that cold air from the evaporator chamber 4 can preferably be applied to it. To achieve temperatures of below 0° the ice maker 5, can if needed, be equipped in a manner known per with additional cooling units such as Peltier elements. Since any automatically operating ice maker can generally be used within the framework of the invention, this unit is not described in any further detail here.

Ice cubes created by the ice maker 5 arrive at a collector 6 arranged below it. A motor-driven worm gear 7 on the floor of the collection container 6 can be actuated to transport ice cubes to a delivery opening 8 at the end of the collector close to the door 6. One of the control buttons 9 is used to set the worm gear 7 in motion.

A cutout 13 on the inner side of the door surrounds the recess 12 as well as a water tank 14, which is embedded at the rear of the recess 12 in an insulation layer of the door 2. The water tank 14 is connected via a feed line 15 and a shut-off valve 16 to a domestic water supply.

Below the delivery opening 8 a feed tube 17 for ice extends through the insulation layer of the door 2 into the recess 12. In the configuration shown in FIG. 1 the feed tube 17 is closed off in an airtight manner by a heat-insulating flap 18, so that no warm air can reach the interior of the refrigeration device from the recess through the feed tube 17. An outlet line 19 extends from the tank 14 into the area of the feed tube 17 lying outside the flap 18.

Figure 4:
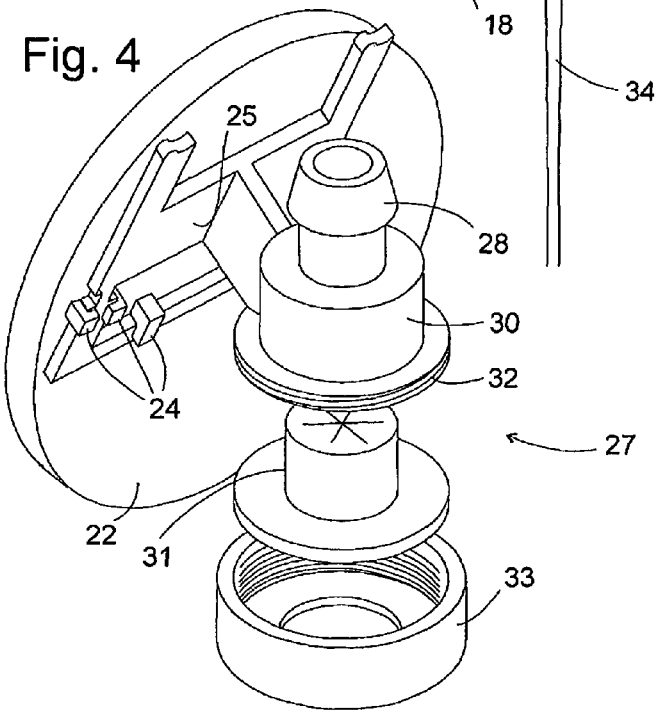
FIG. 4 an exploded diagram of the water outlet of the dispensing device.

The structure of the flap 18 and its environment as well as its method of operation will be explained in more detail with reference to FIGS. 2 to 4.

Figure 2:
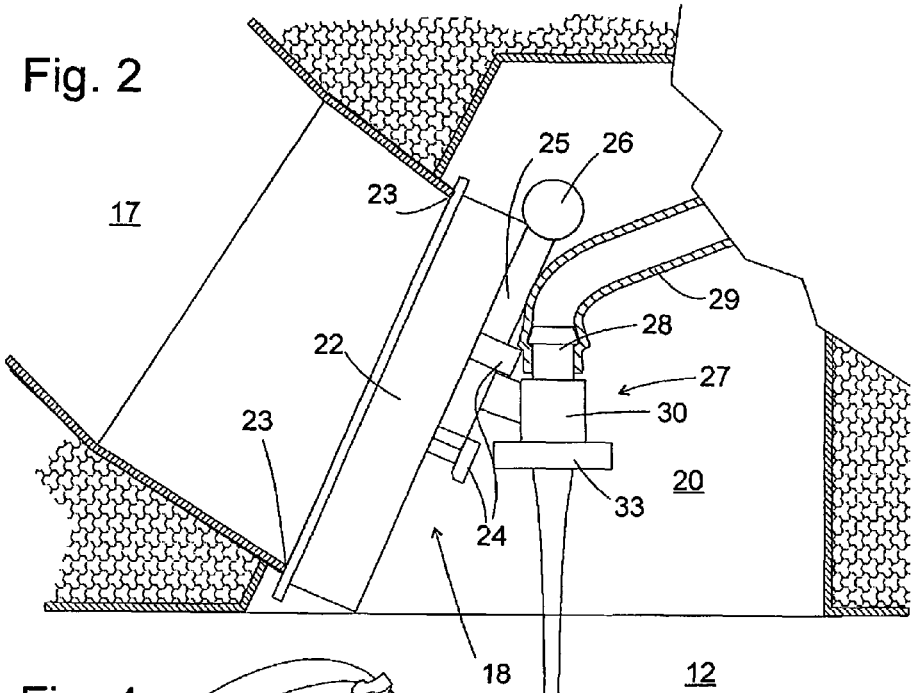
FIG. 2 a schematic side views of the dispensing device while a container is being filled with water.

FIG. 2 shows a section through the lower area of the feed tube 17 and its environment, with the flap 18 closed. The flap 18 is accommodated in a cutout 20 which opens downwards into the recess 12. It comprises a flat cylindrical body 22, which is filled with insulation material and which in the position shown in the figure rests tightly against an exit opening 23 of the feed tube 17 shown in section. The body 22 is latched with the aid of a hook 24 formed in one piece to a plate 25 which is connected in one piece to a shaft 26 running perpendicular to the plane of the section. The shaft 26 is driven by a motor not shown which, in conjunction with actuation of the worm gear 7, opens the flap 18 temporarily.

On the side of the plate 25 facing away from the feed tube 17 is a water outlet 27 formed in one piece. As shown in FIG. 4, the water outlet 27 comprises from top to bottom a nipple 28, onto which a flexible rubber hose 29 is pushed, a container 30 open at the bottom, which accommodates a lip valve 31, and a flange 32 which is provided with an external thread in order to screw a collar 33 onto it, which fixes the lip valve 31 in the container 30. The rubber hose 29 extends through the insulation layer of the door to the tank 14. As can also be seen in FIG. 4, the hooks 24, which anchor the body 22 of the flap to the plate 25, and the plate 25 itself are structured so that the body 22 can be displaced upwards along the plate 25 in order to release it from the plate 25 and replace it if necessary.

In the closed position of the flap 18, as shown in FIG. 2, the longitudinal axis of the water outlet 27 is oriented vertically, so that a stream of water 34 directed vertically downwards can be dispensed.

Figure 3:
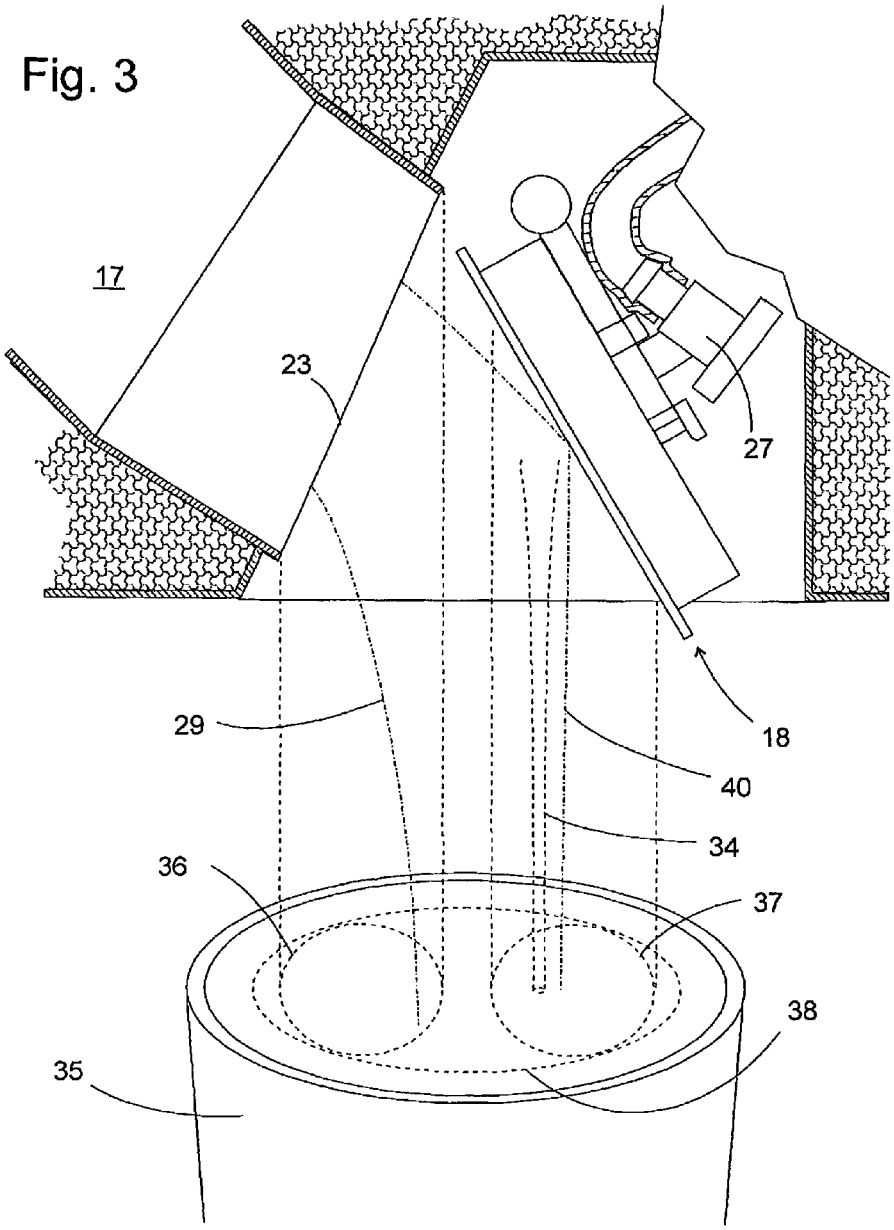
FIG. 3 a schematic view of the dispensing device while a container is being filled with ice.

FIG. 3 shows the flap 18 in its open position with a container 35 placed below it. In this position the shut-off valve 16 is closed, so that no water exits from the outlet 27; this is hinged away to the side. Shown in the figure in a horizontal plane defined by the opening of the container 35 are two ellipses 36, 37, which each correspond to the projection of the exit opening 23 or of the area of the flap 18 in the horizontal covering this opening. A smallest possible circle encompassing the two ellipses is labeled 38. The circle 38 corresponds to approximately the minimum size of a container opening which is required in order to safely catch ice and water that is dispensed. A single ice cube which slides down the feed tube 17, after passing the exit opening 23 typically follows a trajectory indicated by 29, which, depending on the speed of the ice cube, the inclination of the feed tube 17 and distance of the exit opening 23 from the container opening, intersects with one of the two projection ellipses 36, 37 or between these two, but in any case within the circle 38, i.e. the ice moves on a downward path which is delimited by a vertical cylinder spanned by the circle 38. If a large volume of ice is dispensed simultaneously it can be that ice cubes collide with the open flap 18 and are deflected by this, as shown by the track 40. They also arrive within the circle 38 in the container opening.

The stream of water 34 shown in FIG. 3 also arrives within the projection ellipse 37. It is obvious that the point at which the stream of water 34 arrives at the container opening depends on the position of the outlet 27 on the flap 18. The lower the outlet 27 is placed, the further to the left it can be displaced in the perspective of FIG. 2, 3, so that the stream of water 34, if desired, can also arrive within the projection ellipse 36 of the exit opening 23. Since in each case the container 35 is able to be placed vertically below the outlet 27, it is ensured that drops which continue to drop from the outlet after the shut-off valve 16 is closed, arrive in the container 35 and are not sprayed around within the recess 12, and also a container with a small opening can be safely filled.

The invention claimed is:

1. A dispensing device for free-flowing or pourable products, the dispensing device comprising:

a feed tube for pourable products, the feed tube having an exit opening and a flap movable between a free passage and a closing position in which the flap closes off the feed tube at the exit opening; and an outlet for a free-flowing product, the outlet being secured to an exterior of the flap and movable with the flap.

2. The dispensing device as claimed in claim 1, wherein the outlet is configured to create a stream of liquid directed vertically downwards.

3. The dispensing device as claimed in claim 1, wherein the outlet is configured to create a stream of liquid flowing along a liquid flow path that extends within a drop path along which a pourable product drops from the dispensing device.

4. The dispensing device as claimed in claim 1, wherein an exit opening of the outlet lies within the smallest vertical cylindrical area that surrounds the flap in its open position and the exit opening of the feed tube.

5. The dispensing device as claimed in claim 1, wherein the outlet is connected via a flexible tube to a tank.

6. The dispensing device as claimed in claim 5, wherein a shut-off valve is arranged upstream from the flexible tube.

7. The dispensing device as claimed in claim 1, wherein the outlet is provided with a lip valve.

8. A refrigeration device comprising:

a compartment in which items to be cooled are retained; and a dispensing device for free-flowing or pourable products, the dispensing device including a feed tube for pourable products, the feed tube having an exit opening and a flap movable between a free passage and a closing position in which the flap closes off the feed tube at the exit opening and an outlet for a free-flowing product, the outlet being secured to an exterior of the flap and movable with the flap.

* * * * *